US009482031B2

(12) United States Patent
Field et al.

(10) Patent No.: US 9,482,031 B2
(45) Date of Patent: Nov. 1, 2016

(54) CYLINDER LOCK INCLUDING MULTIPLE COOPERATING SIDEBARS FOR CONTROLLING THE LOCK

(71) Applicant: MEDECO SECURITY LOCKS, INC., Salem, VA (US)

(72) Inventors: Peter H. Field, Salem, VA (US); Torsten Quast, Berlin (DE)

(73) Assignee: ASSA ABLOY HIGH SECURITY GROUP INC., Salem, VA (US)

( * ) Notice: Subject to any disclaimer, the term of this patent is extended or adjusted under 35 U.S.C. 154(b) by 0 days.

(21) Appl. No.: 14/811,951

(22) Filed: Jul. 29, 2015

(65) Prior Publication Data

US 2016/0032618 A1 Feb. 4, 2016

Related U.S. Application Data

(60) Provisional application No. 62/031,428, filed on Jul. 31, 2014.

(51) Int. Cl.
*E05B 27/00* (2006.01)
*E05B 29/00* (2006.01)

(52) U.S. Cl.
CPC ..... *E05B 27/0082* (2013.01); *E05B 27/0078* (2013.01); *E05B 29/0066* (2013.01); *E05B 2027/0025* (2013.01)

(58) Field of Classification Search
CPC .... E05B 9/04; E05B 15/0053; E05B 15/006; E05B 21/00; E05B 21/06; E05B 27/00; E05B 27/007; E05B 27/0014; E05B 27/0057; E05B 27/0082; E05B 29/00; E05B 29/0053; E05B 29/0066; E05B 2027/0025; E05B 2027/10
See application file for complete search history.

(56) References Cited

U.S. PATENT DOCUMENTS

| | | | | |
|---|---|---|---|---|
| 167,088 | A | 8/1875 | Felter | |
| 1,965,336 | A | 7/1934 | Fitz Gerald | |
| 2,021,185 | A * | 11/1935 | Hurd | E05B 27/0082 70/419 |
| 2,629,247 | A | 2/1953 | Deutsch | |
| 2,660,876 | A | 12/1953 | Spain | |
| 3,623,345 | A | 11/1971 | Solitanner | |
| 3,722,241 | A | 3/1973 | Sussina | |
| 3,990,282 | A | 11/1976 | Sorum | |
| 4,815,307 | A | 3/1989 | Widen | |
| 5,475,998 | A * | 12/1995 | Raskevicius | E05B 27/0082 70/358 |
| 6,427,506 | B1 | 8/2002 | Prunbauer | |
| 6,755,063 | B2 | 6/2004 | Takadama | |
| 7,377,146 | B2 * | 5/2008 | Field | E05B 19/0017 70/409 |
| 7,392,677 | B1 * | 7/2008 | Fan | E05B 29/00 70/377 |
| 7,673,484 | B1 * | 3/2010 | Crepinsek | E05B 17/14 70/358 |
| 8,448,485 | B1 * | 5/2013 | Widen | E05B 27/0017 70/378 |

(Continued)

*Primary Examiner* — Christopher Boswell
(74) *Attorney, Agent, or Firm* — Rothwell, Figg, Ernst & Manbeck PC

(57) ABSTRACT

A cylinder lock includes a side bar assembly comprising a binding bar and a testing bar and code pins, each comprising a key projection, a code hole, and binding features. Partial rotation of the cylinder causes the binding bar to engage the binding features of the code pins to prevent radial movement of the pins. If the code holes of the code pins are aligned with code points of the testing bar, the testing bar is able to move inwardly with the binding bar and out of the slot so as to permit the cylinder to rotate within the bore. If one or more code holes is not aligned with a code point of the testing bar, the code point will contact the body of the code pin and thereby be prevented from moving radially inwardly out of a locking slot, thus blocking rotation of the cylinder.

17 Claims, 20 Drawing Sheets

(56) References Cited

U.S. PATENT DOCUMENTS

2006/0101880 A1* 5/2006 Ward-Dolkas ..... E05B 29/004 70/492

2015/0184422 A1* 7/2015 Chang ..... E05B 29/0066 70/357

2015/0211256 A1* 7/2015 Field ..... E05B 19/0064 70/350

* cited by examiner

A squiggle key

A sawn key

CYLINDER LOCK INCLUDING MULTIPLE COOPERATING SIDEBARS FOR CONTROLLING THE LOCK

CROSS REFERENCE OF RELATED APPLICATION

This application claims the benefit under 35 U.S.C. §119 (e) of the filing date of provisional patent application Ser. No. 62/031,428 filed Jul. 31, 2014, the disclosure which is incorporated herein by reference.

FIELD OF THE DISCLOSURE

This disclosure relates to cylinder locks with dual-acting sidebars. In particular, this disclosure relates to a cylinder lock that has a plug rotatably mounted in a shell and is locked against turning by a sidebar mechanism that allows for a partial rotation of the plug before the sidebar is tested at the edge of a sidebar slot in the shell, wherein, during the partial rotation, code pins are blocked from movement by part of the sidebar.

BACKGROUND

Sidebar mechanisms found in cylinder locks include a sidebar that spans across the shear line of the cylinder and blocks the rotation of the plug relative to the shell. Such sidebar mechanisms usually perform their locking function in any of a number of ways. First, the sidebars can be biased outwardly from the plug and are forced inwardly by the rotation of the plug acting on an exterior sloping surface (see U.S. Pat. No. 167,088 Felter), or second, the sidebars can be biased inwardly towards detainers in the plug, and a sloping surface on the interior of the sidebar is forced outwardly by the stronger bias of the detainers (see U.S. Pat. No. 1,965,336 FitzGerald).

In the context of this disclosure, when used to describe a sidebar, the term "inner," "interior," or "inwardly" refers to a radially inner or interior surface, side, end, edge, portion, or direction of the sidebar relative to the axis of rotation of the plug, or cylinder, of the lock, and the term "outer," "exterior," or "outwardly" refers to a radially outer or exterior surface, side, end, edge, portion, or direction of the sidebar relative to the axis of rotation of the cylinder lock.

Sidebars that are biased outwardly usually have sloping edges on their exterior surface and straight edges on their interior surface so that the detainers have to be precisely aligned for the sidebar to fit into the unlocking position. Sidebars that are biased inwardly usually have a sloping surface on their interior surface, and straight or undercut blocking edges on their exterior so that rotation on the plug does not force the sidebar into further contact with the detainers. Additionally, a third type of sidebar can act to bind the detainers as the plug starts to rotate so that the detainers can no longer be manipulated into an unlocking position (see U.S. Pat. No. 3,722,241 Sussina). Other sidebars have a full round cross sectional shape or have beveled surfaces on both their interior and exterior edges (see U.S. Pat. No. 3,623,345 Solitanner). The round or beveled edges on these sidebars allow for return motion of the key to force the sidebar out across the shear line and relock the cylinder without additional biasing methods.

U.S. Pat. No. 2,629,247 to Deutsch describes a cylinder having two sidebars, one on each side of the plug. Both sidebars 19, 19a have beveled surfaces on their exterior edges and are urged outwardly by split ring springs 26. The sidebar on one side of the plug reads the tumbler as the plug starts to turn one direction (clockwise), and the sidebar on the other side of the plug reads the tumbler as the plug turns the other direction (counter clockwise). The reading of the tumblers by the sidebars is performed as the plug is turned, and one of the downward and inwardly sloping cam surfaces 29 located on the interior of the shell moves the adjacent sidebar inwardly. Both sidebars have similar detainer-reading functions and both are spring-biased outwardly.

U.S. Pat. No. 2,660,876 to Spain describes a cylinder that uses a sidebar mechanism constructed of two rods 29, 30 spring-loaded inwardly, whereby if the plug 21 is turned without having the tumbler 18 aligned correctly, the outer sidebar rod 30 moves into a widened portion 24a of the sidebar cavity in the plug and limits the plug from turning any further. When the rod 30 is moved to a binding position, most of the force applied to rotate the plug further is directed to the widened portion of the sidebar cavity and not against the detainers.

While Spain illustrates a dual-piece sidebar mechanism, it lacks a two piece sidebar as having separate binding and testing members that operate sequentially to bind and then test the tumblers.

U.S. Pat. No. 3,990,282 to Sorum describes a cylinder that uses a multi-piece sidebar to engage with flat sliding tumblers 27 that move from side to side in the cylinder. The multi-piece sidebar has an outer portion (locking block 37) that is biased outwardly by springs 40 and moves towards the tumblers as the plug is rotated, causing the tumblers to bind at a side to side location. The sidebar also has an inner portion (release tongue 43) that is spring-loaded 47 away from the tumblers and is forced towards the tumblers as the plug is turned. The tongue 43 has a thin edge 45 that must enter into a square opening (release slot 51) in the tumblers for the cylinder to be unlocked.

The lock of Sorum lacks an inwardly-biased testing sidebar having a beveled interior edge that contacts a beveled surface on the detainer.

U.S. Pat. No. 6,755,063 to Takadama describes a changeable cylinder with a sidebar 22 biased outwardly and located inside a sidebar holder 19. Rotation of the plug moves the sidebar holder to a position aligned with a receiving slot in the shell, and the sidebar holder can move outwardly to allow the tumblers to be realigned to a new combination. The sidebar moves into the tumblers when they are aligned by the correct key so that the sidebar-engaging concave portion 12 is in the opening position. Rotation of the plug forces the sidebar front end portion 23 out of the receiving slot in the shell and forces the sidebar into the sidebar engaging concave portion 12 in the tumbler.

The outer portion of the sidebar mechanism of Takadama with the beveled edge that surrounds the two sides of the sidebar is actually a compression member that keeps the changeable detainers coupled together after they have been set to a new combination. It does not provide any sidebar function of unlocking or binding.

U.S. Pat. No. 4,815,307 to Widen describes (for example, in FIG. 17 and others) a cylindrical pin 23 with a projecting finger 57 that has a substantially beveled surface (57', 57", 57'") designed to contact the bitting on a key. As shown in FIG. 12 of Widen, the pins also have a hollow cavity at the other end of the pin that accepts a spring to bias the pin against the key. This pin interacts with a sidebar locking device at the back side of the cylindrical body 39a.

U.S. Pat. No. 6,427,506 to Praunbauer describes a cylinder that incorporates finger pins 10 with body 5 of a rectangular shape and a finger like projection 9 with a beveled surface 29 for contact with the key bitting surface. Additionally the finger pins have a projection 17 for contacting an external spring and a notch 11 for sidebar interface. The cylinder uses a sidebar 6 that is spring loaded 24 outwardly. Sidebar legs 12 contact the finger pins, and when correctly aligned, these legs fit into the notches 11.

SUMMARY OF THE DISCLOSURE

The following presents a simplified summary in order to provide a basic understanding of some aspects described herein. This summary is not an extensive overview of the claimed subject matter. It is intended to neither identify key or critical elements of the claimed subject matter nor delineate the scope thereof. Its sole purpose is to present some concepts in a simplified form as a prelude to the more detailed description that is presented later.

One proposed embodiment of the new cylinder would use a new pin similar to the Widen pin described above and is described in relation to the structure of that prior art pin. It is redesigned and inverted to have the key contact area on a beveled surface on the opposite side of the finger projection (in the area identified as 60' in FIG. 17 and FIG. 18 of Widen) and has the cylindrical body shape of the pin extended to the top of the finger portion and has the cavity for the spring on the other end of the Widen pin in the area near the new finger projection. This pin is inserted from the bottom of a plug into a hole beside the keyway, and the finger projects into the keyway. The spring pushes the finger projection down against the sawn key surface and the bittings elevate the pins against the spring bias. The back side of the cylindrical body of the pin would contact the sidebar mechanism of the second sidebar embodiment as described above. The pin would be elevated by the key, and it could also be rotated for additional security.

The cylinder using the pin described in relation to the Widen pin is further described in relation to the prior art Praunbauer pin. The key contact area is similar to the finger projection of the Praunbauer pin, however, the body shape can be cylindrical, and the pin has a cavity into the body of the pin at the opposite end of the pin from the finger projection. The finger projection can extend further than the Widen or Praunbauer pins so that it fully crosses and contacts the complete width of the key blade. The pin can also extend into a cavity in the opposite side of the keyway wall to prevent rotation of the pin during key insertion.

An embodiment of a sidebar disclosed herein incorporates two sidebars that sequentially affect the operation of code pins, or detainers, in the cylinder. One sidebar, known as the "binding sidebar" is biased outwardly, and, as the plug first starts to turn, the sidebar is forced inwardly and functions to bind the code pins. As the plug continues to turn, a second, inwardly-biased sidebar known as the "locking sidebar" or "testing sidebar" tests the positioning of the code pins. If the code pins are not correctly aligned, the second sidebar is unable to move inwardly out of a sidebar slot formed in the shell, and the outer edge of the second sidebar blocks any further rotation of the plug.

Thus, due to the pin-binding function of the binding sidebar, a partial rotation of the cylinder—such as might be attempted to set, or pick, the pins—binds, or freezes, the pins against further movement of the pins, thereby preventing the pins from being manually elevated to pick the lock.

Further to the first embodiment, the binding sidebar that is biased outwardly has beveled edges on the exterior of the sidebar, and the exterior of the binding sidebar fits into a slot in the interior of the shell. When the plug turns, a beveled edge of the slot in the shell forces the binding sidebar inwardly into the plug. The locking, or testing, sidebar that is spring loaded inwardly fits into a slot in the shell that may have a squared edge. The locking, or testing, sidebar has a squared exterior edge, and the slot in the shell is wider than the width of the projecting edge of the testing sidebar. The width of the sidebar slot is determined to allow the binding sidebar to move into a binding position against the detainers before the projecting edge of the testing sidebar contacts squared edges of the sidebar slot to prevent further rotation of the cylinder.

A variation of this first embodiment encompasses two sidebars and respective slots that are located on opposite sides of the plug. Another modification has the two sidebars on the same side of the plug separated by a slight thickness in the plug. A third modification has the two sidebars lying end-to-end next to each other in the same slot. The sidebars project from the plug into the shell at different locations along the length of the plug, and the shape of the sidebar slot or the shape of the sidebar edges vary in shape and width along the length of the shell.

A second embodiment incorporates a multi-piece sidebar assembly that sequentially functions to perform the binding and testing operations. The new sidebar is both biased outwardly towards the shell and inwardly towards the detainers. This sidebar is configured to perform the functions of binding the detainers as the plug first starts to rotate with a portion of the sidebar that is biased outwardly and then testing the alignment of the detainers as the plug turns further to the opening position with a portion of the sidebar that is biased inwardly. The sidebar provides sequential binding of the detainers and testing of their positions before allowing unlocking of the plug.

One application for a cylinder lock embodying aspects of the disclosure would be in a cylinder operated with a flat, generally rectangular key—commonly known as a "vertical sawn key"—that positions pins within the plug having projections that extend off the body of the pins to contact the bittings on the key blade.

Other features and characteristics of the present disclosure, as well as the methods of operation, functions of related elements of structure and the combination of parts will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The accompanying drawings, which are incorporated herein and form part of the specification, illustrate various, non-limiting embodiments. In the drawings, common reference numbers indicate identical or functionally similar elements.

DETAILED DESCRIPTION

Figure 1:
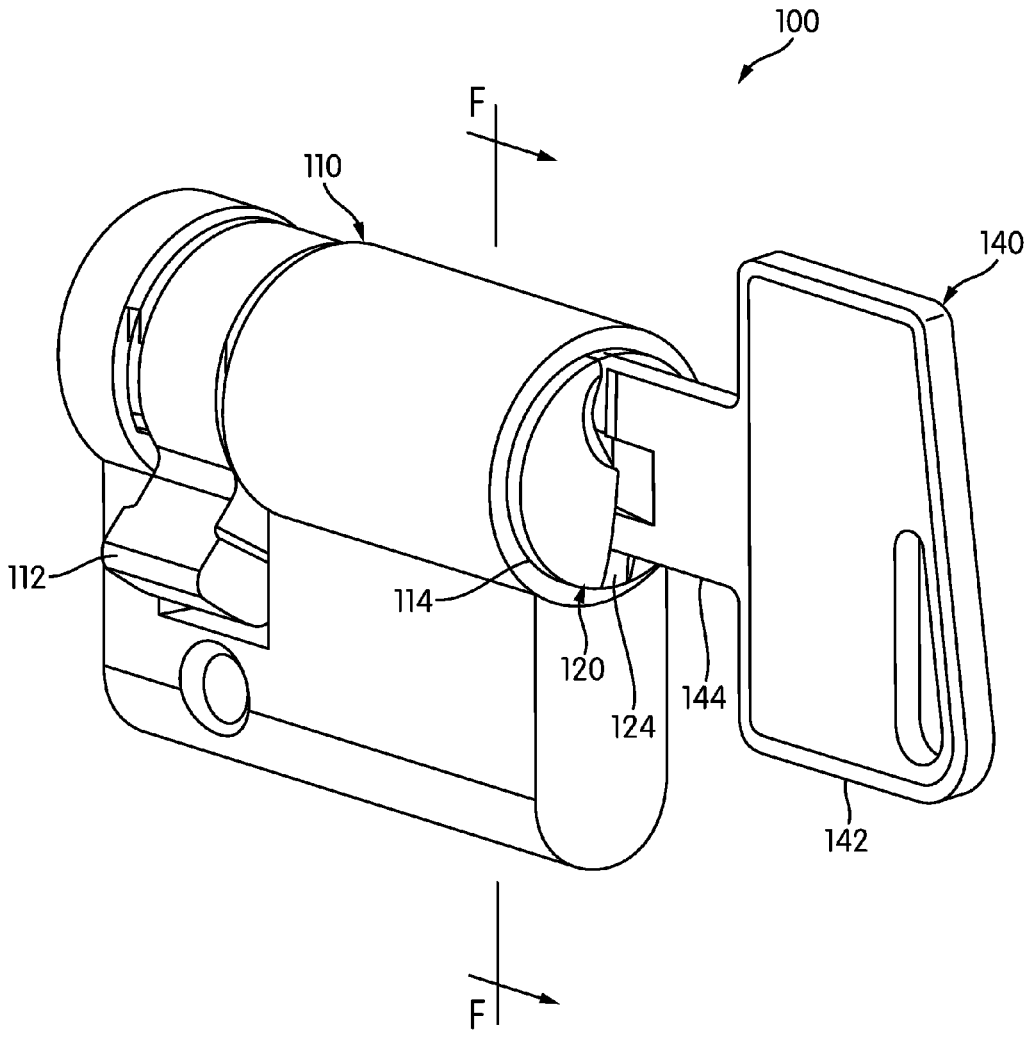
FIG. 1 is a perspective view of a cylinder lock embodying aspects of the present disclosure.

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

Unless otherwise indicated or the context suggests otherwise, as used herein, "a" or "an" means "at least one" or "one or more."

This description may use relative spatial and/or orientation terms in describing an absolute or relative position and/or orientation of a component, apparatus, location, feature, or a portion thereof. Unless specifically stated, or otherwise dictated by the context of the description, such terms, including, without limitation, top, bottom, above, below, under, on top of, upper, lower, left of, right of, in front of, behind, next to, adjacent, between, horizontal, vertical, diagonal, longitudinal, transverse, radial, axial, etc., are used for convenience in referring to such component, apparatus, location, feature, or a portion thereof in the drawings and are not intended to be limiting.

Furthermore, unless otherwise stated, any specific dimensions mentioned in this description are merely representative of an exemplary implementation of a device embodying aspects of the disclosure and are not intended to be limiting.

I. First Embodiment

A lock and key assembly 100 embodying aspects of the present disclosure is shown in FIG. 1. The assembly includes a housing 110 having a bore 114 formed therein which receives a plug, or cylinder, 120. A key 140 is inserted into a keyway 124 of the plug 120. The lock of the assembly 100 shown in FIG. 1 is a type of lock commonly known as a European profile cylinder lock. In various embodiments, the plug 120 is operatively coupled to a latch mechanism such that rotation of the plug 120 effects operative actuation of the latch mechanism. In the illustrated embodiment, the lock includes a locking cam 112 that is coupled to the plug 120 so as to be rotatable to operate the lockset within a door or other structure within which the cylinder is installed. Aspects of the disclosure may be embodied in different types of plugs and associated locking mechanisms that can be incorporated into a lock, such as lock 100. The plugs and locking mechanisms may also be incorporated into other types of locks.

A. Key

Figure 2:
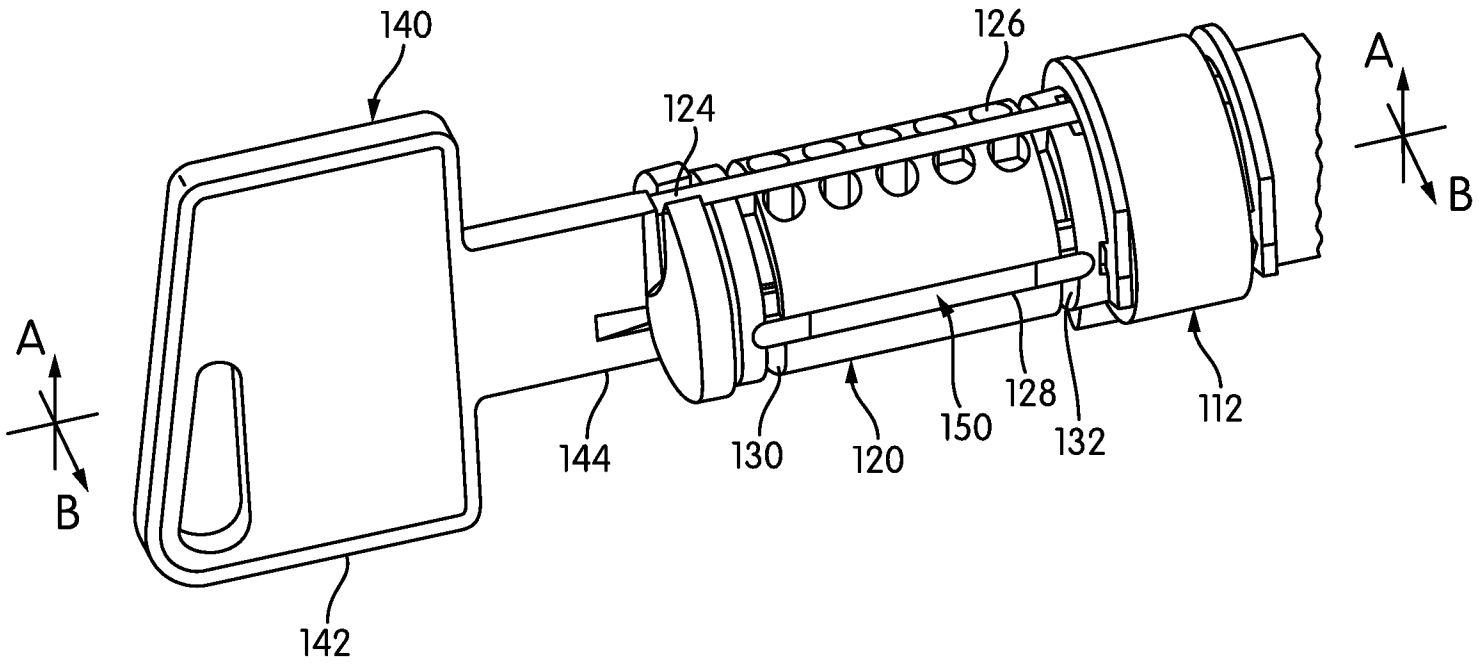
FIG. 2 is a perspective view of a plug of the lock and key with the housing, or shell, of the lock removed.
Figure 23:
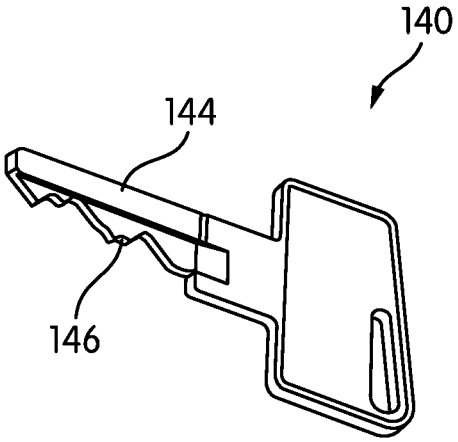
FIG. 23 is a perspective view of a sawn key configured to be used in a lock embodying aspects of the present disclosure.

FIG. 2 shows a key 140 and corresponding plug 120 of a lock embodying aspects of the present disclosure. FIG. 23 is a perspective view of a sawn key 140 to be used in a lock embodying aspects of the present disclosure. The key 140 includes a bow 142 and a blade 144 extending from the bow and configured to be inserted into the keyway 124 of the plug 120. The blade 144 may include a bitted edge 146 (see, e.g., FIGS. 5-7, 23) for positioning code pins, or detainers, within the plug 120 in a manner that will be described in further detail below. The blade 144 may further include external features, or warding, such as longitudinally extending grooves and/or ridges, that match corresponding warding provided in the keyway 124 so that only a properly warded key blade can be inserted into the keyway.

B. Plug

Figure 3:
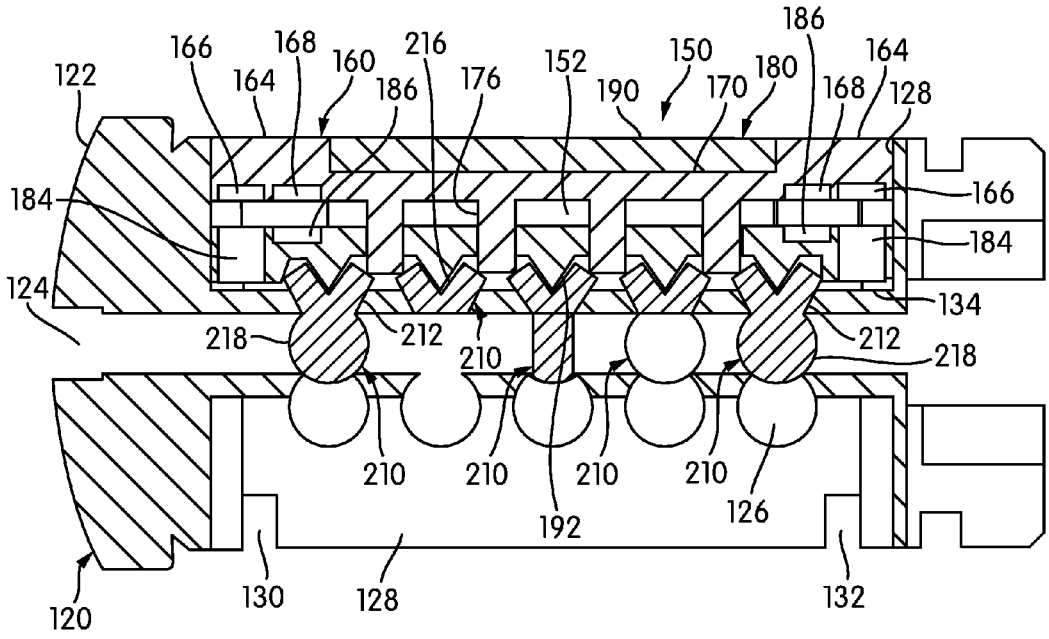
FIG. 3 is a cross-section of the plug along the line A-A in FIG. 2 and with the key omitted from the figure.
Figure 4:
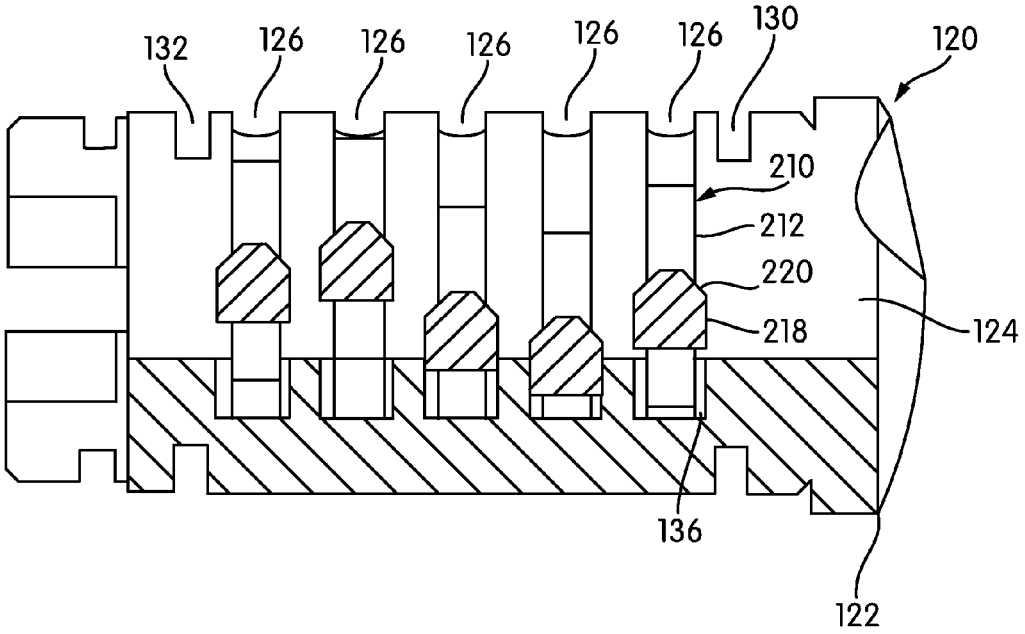
FIG. 4 is a cross-section of the plug in the direction B-B of FIG. 2 and with the key omitted from the figure.

Referring primarily to FIGS. 2-4, in various embodiments, plug 120 includes a head 122 at a front end thereof that projects from the housing 110 of the lock. The keyway 124 extends longitudinally of the cylinder plug 120 and may be open along a surface of the plug 120, as shown in FIG. 2. A sidebar assembly 150 is disposed within a sidebar slot 128 that extends radially into the plug 120 and is oriented longitudinally along at least a portion of the length of the plug. Plug 120 may include, in one embodiment, two diametrically opposed sidebar slots 128, each configured to receive a sidebar assembly, such as sidebar assembly 150.

Plug 120 may further include a plurality of code pin holes 126 aligned along the keyway 124. The illustrated embodiment includes five code pin holes 126 located on each side of the keyway 124. Alternate embodiments may have more or fewer pin holes and may have pin holes on only one side of the keyway 124.

In one embodiment, as shown in FIG. 4, a plurality of holes 136, typically corresponding in number and axial position to the code pin holes 126, may be formed along a closed edge (along the bottom in FIG. 4) of the keyway 124. Holes 136 are provided to receive a portion of the code pin 210 disposed in each of the code pin holes 126 as will be described in further detail below.

C. Sidebar Assembly

Figure 10:
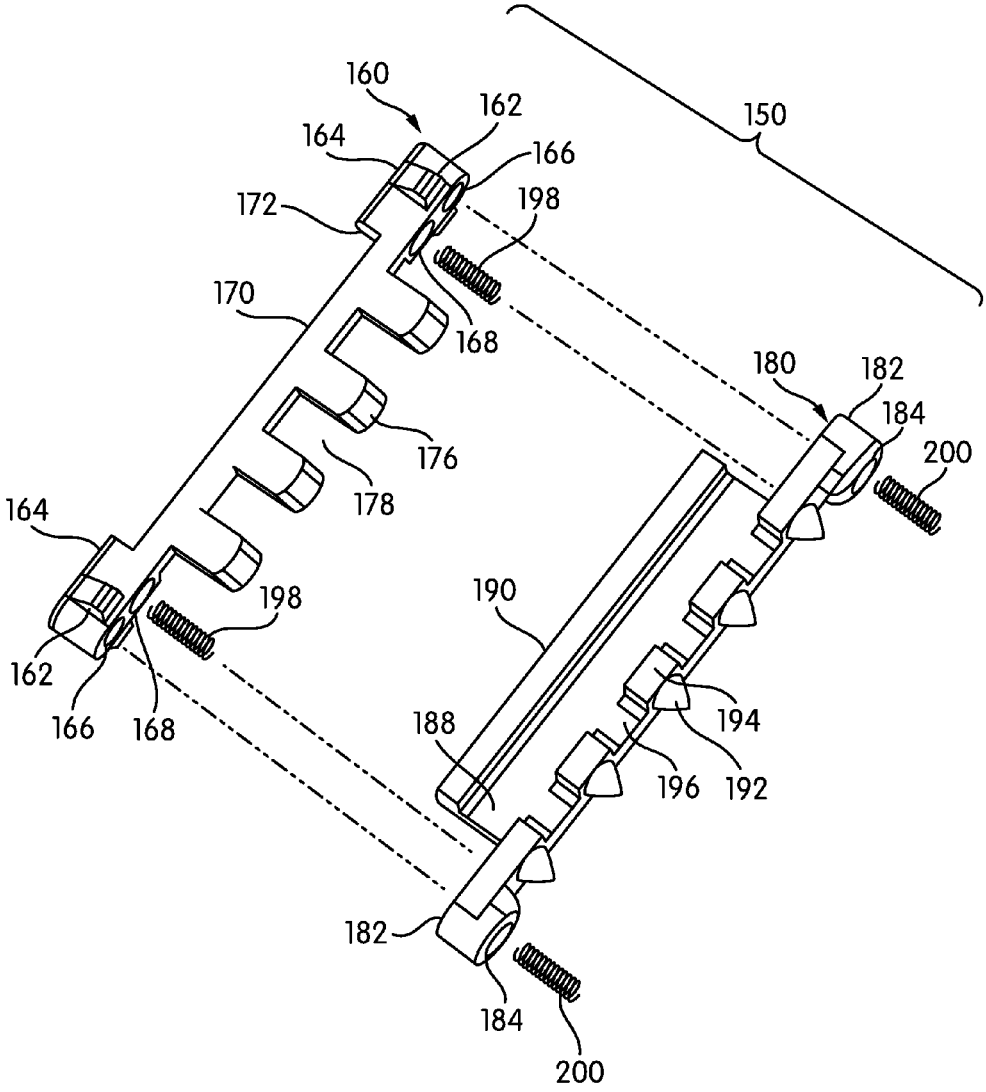
FIG. 10 is an exploded perspective view of the sidebar assembly.
Figure 11:
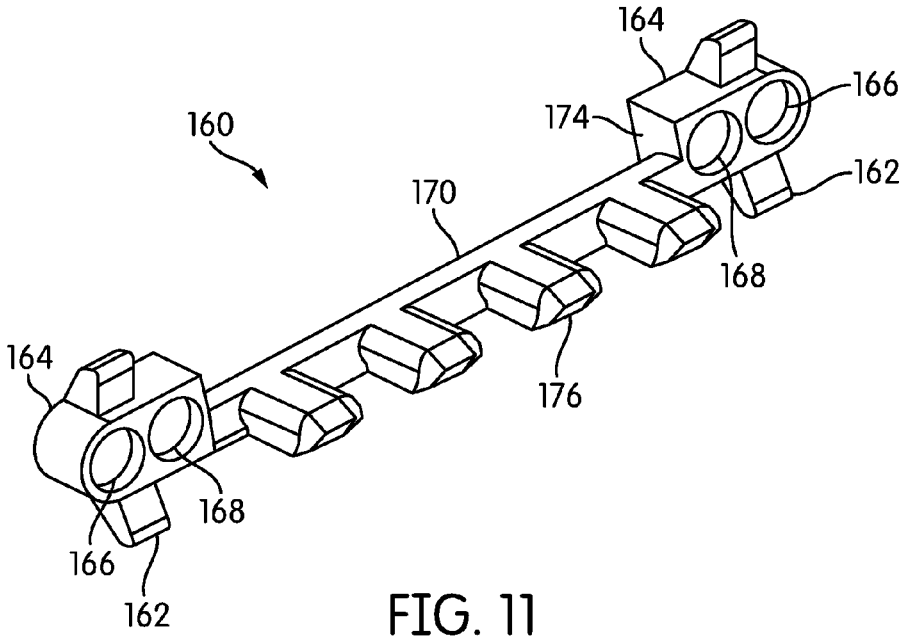
FIG. 11 is a perspective view of a binding bar of the sidebar assembly.
Figure 12:
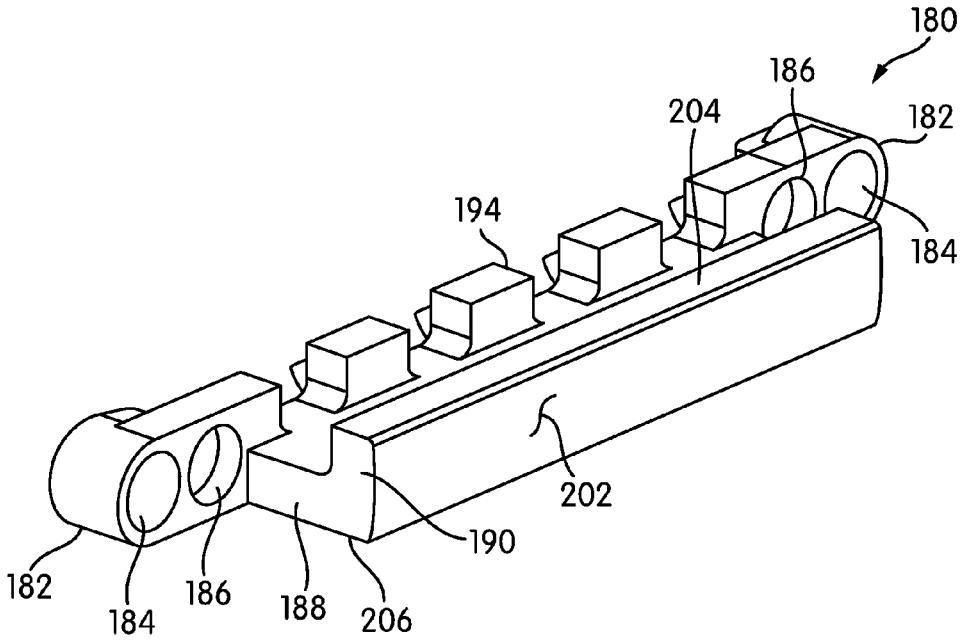
FIG. 12 is a perspective view of a locking, or testing, bar of the sidebar assembly.
Figure 13:
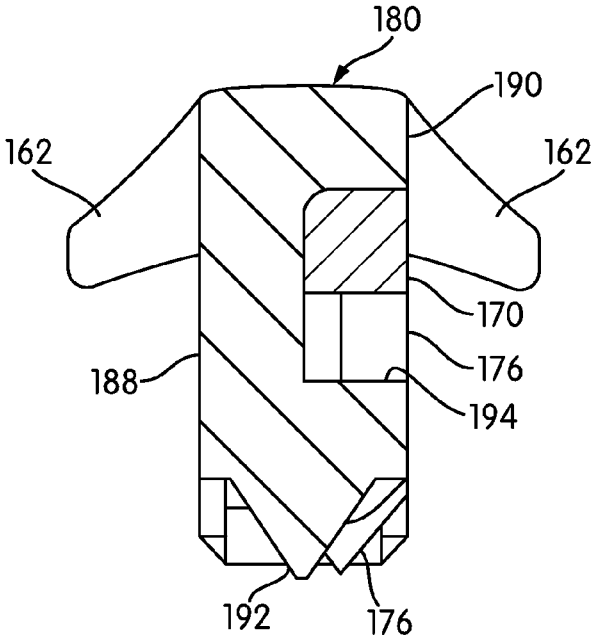
FIG. 13 is a cross-sectional view of the sidebar assembly along the line D-D in FIG. 8.
Figure 14:
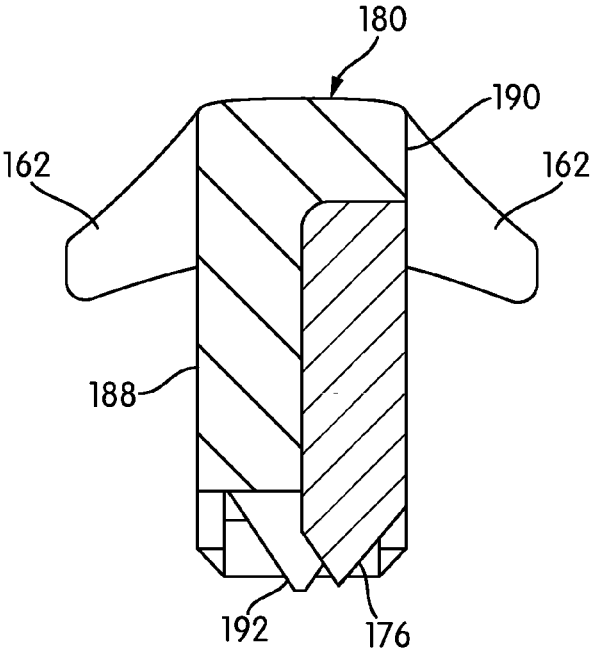
FIG. 14 is a cross-sectional view of the sidebar assembly along the line E-E in FIG. 8.

Referring to FIGS. 8-12, in various embodiments, the sidebar assembly 150 includes a binding bar 160 and a locking, or testing, bar 180, which are operatively coupled together. As shown in FIG. 11, the biding bar 160 includes end portions 164 at opposite ends thereof and a longitudinal element, or spar, 170 extending between the end portions 164. The width and thickness of the spar 170 is less than that of the end portions 164, thereby defining a first offset 172 (see FIG. 10) and a second offset 174 (see FIG. 11). Cam features, such as laterally extending, sloped, or beveled, bridges 162, are provided on the binding bar 160, for example, on each of the end portions 164. Each end portion 164 also includes an outer spring cup 166 and an inner spring cup, each comprising a blind hole and configured to receive and hold the end of a coil spring. A plurality of binding projections, or points, 176 extend laterally from longitudinally-spaced apart positions from the spar 170. The illustrated embodiment comprises four binding projections 176, but, in other embodiments, the binding bar 160 may include more or less than four binding projections 176.

As seen in FIGS. 10-14, in various embodiments, the locking bar 180 includes end portions 182 and a channel-like structure extending between the end portions 182 defined by a lateral retainer flange 190 extending from a web section 188 and projecting legs 194 extending laterally from spaced apart longitudinal positions on the web 188. In various embodiments, the retainer flange 190 presents a rectangular outer edge 202 with squared (i.e., substantially right-angled) sides 204, 206, wherein side 206 coincides with web 188. Each end portion 182 of the locking bar 180 further includes a spring hole 184 extending through the end portion 182 and a spring cup 186 defined by a blind hole formed in the end portion 182. The locking bar 180 also include code points 192, one projecting from each of the projecting legs 194 and from each end portion 182. The illustrated embodiment comprises five code points 192, but, in other embodiments, the locking bar 180 may include more or less than five code points 192.

As shown in FIGS. 8-10 and 13-14, the biding bar 160 and the locking 180 are coupled together to form the sidebar assembly 150. The binding bar 160 is positioned into the locking bar 180 with the spar 170 of the binding bar 160 disposed between the retainer flange 190 and the projecting legs 194 of the locking bar 180. The binding points 176 of the binding bar 160 extend through the gaps 196 between adjacent projecting legs 194 of the locking bar 180. Similarly, the projecting legs 194 extend into gaps 178 between adjacent binding points 176 of the binding bar 160. The size of the first offset 172 of the binding bar 160 preferably corresponds to the width of the portion of the retainer flange 190 extending from the web 188, and the size of the second offset 174 of the binding bar 160 preferably corresponds to the thickness of the web 188 of the locking bar 180 so that the binding bar 160 and the locking bar 180 fit together in a flush manner as shown in FIGS. 8, 9, 13, and 14.

As shown in FIG. 10, inner springs 198 are positioned between the binding bar 160 and the locking bar 180, with the ends of the springs 198 disposed within the inner spring cups 168 of the binding bar 160 and the spring cups 186 of the locking bar 180. Outer springs 200 extend through the spring holes 184 of the locking bar 180 and into the outer spring cups 166 of the binding bar 160.

D. Code Pins

Figure 19:
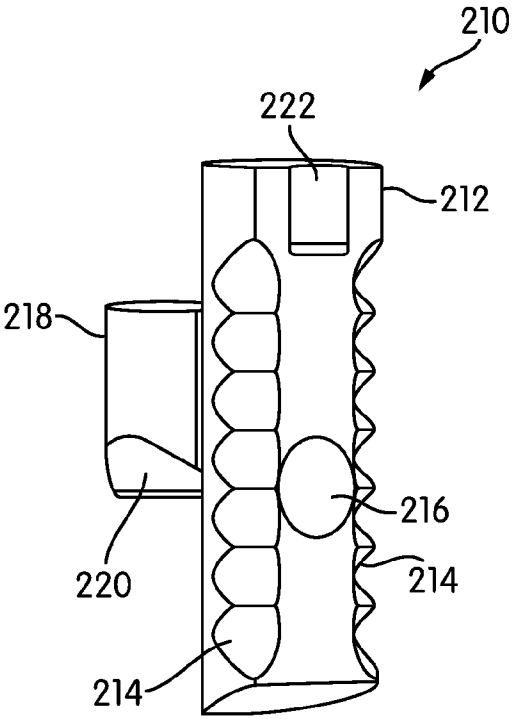
FIG. 19 is a second perspective view of the code pin.
Figure 18:
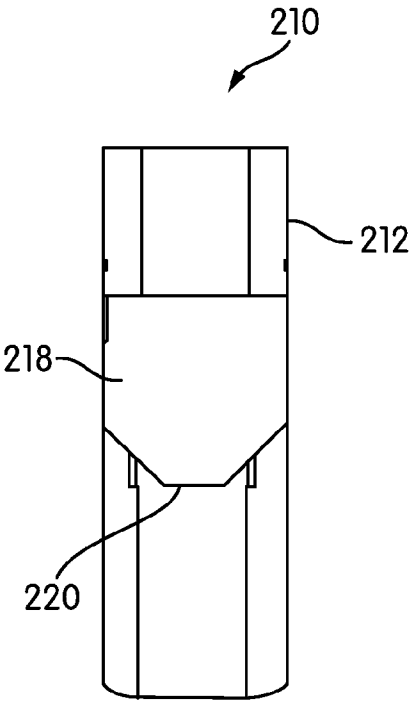
FIG. 18 is a side view of the code pin.
Figure 17:
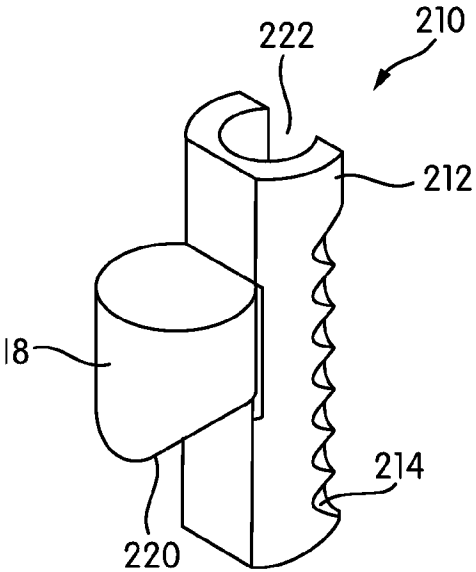
FIG. 17 is a first perspective view of a code pin of the lock.

As shown in FIGS. 17-19, each code pin 210 includes a pin body 212 with a spring hole 222 extending into one end of the pin body 212. In various embodiments, as illustrated, pin body 212 may be generally cylindrical with flattened front and/or back sides, or the pin body may have another shape such as square, rectangle, triangle or another polygonal shape. A key projection 218 is appended to the pin body 212 and includes a key-engaging surface, such as a chisel point 220, on one end thereof. Binding features, such as binding teeth 214, extend along two sides of the pin body 212. A code hole 216, or other code feature, is formed into a side of the pin body 212 opposite the key projection 218. The location of the code hole 216 on the pin body 212 and the location of the key projection 218 on the pin body 212 provides the unique coding for the lock, as the locations of the code hole 216 and key projection 218 can be different for each of the code pins 210 in the lock.

A plurality of code pins 210 is provided in the lock assembly, each transversely mounted for radial movement within one of the code pin holes 126 in the plug 120 with each key engaging surface disposed within the keyway 124. As shown in FIG. 4, one code pin 210 is disposed in each of the code pin holes 126 of the plug 120. Specifically, the pin body 212 of each code pin 210 is disposed in an associated code pin hole 126. The key projection 218 of each code pin 210 is disposed in the keyway 124 of the plug 120. As shown in FIG. 3, the code pins 210 are disposed within the code pin holes 126 extending along only one side of the keyway 124. In other embodiments, a second set of code pins could be disposed the code pin holes 126 extending along the opposite side of the keyway 124.

E. Alternative Code Pins

Figure 20:
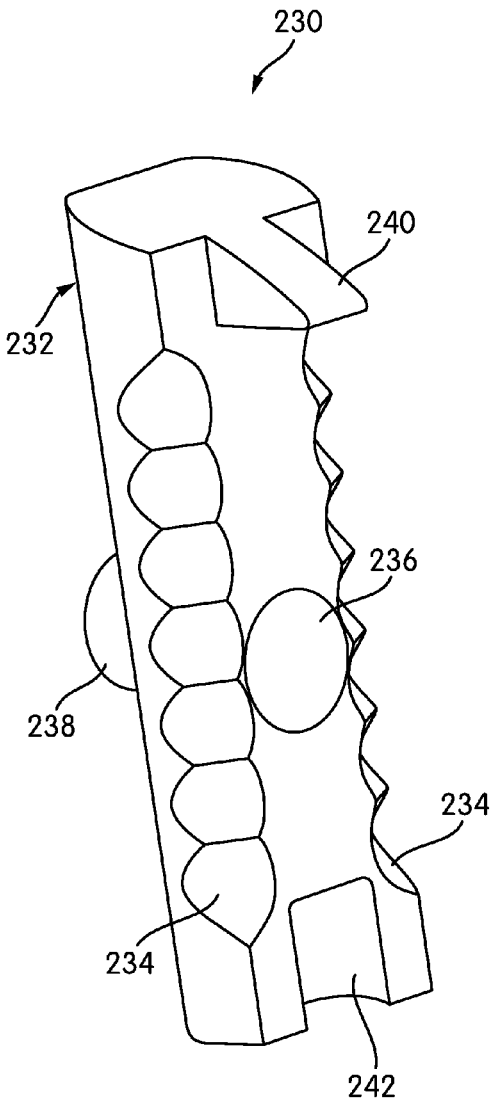
FIG. 20 is a first perspective view of an alternative embodiment of a code pin of the lock.
Figure 21:
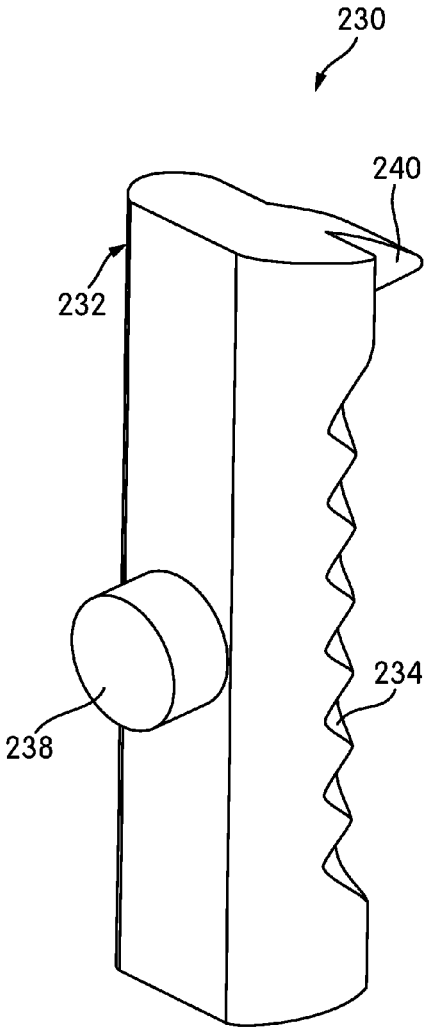
FIG. 21 is a second perspective view of the alternative embodiment of the code pin.

FIGS. 20 and 21 are perspective views of an alternative embodiment of a code pin 230. Code pin 230 includes a pin body 232 with a spring hole 242 extending into one end of the pin body 232. Binding teeth 234 extend along two sides of the pin body 232. A code hole 236 is formed into a side of the pin body 232. Unlike code pin 210 described above, code pin 230 does not include a key projection with a chisel point 220, but instead has a cylindrical protrusion 238 as a key-engaging surface that extends from the pin body 232. Code pin 230 further includes a lateral extension 240. Extension 240 is configured to be disposed within a slot formed in the plug and extending from the code pin hole to prevent the code pin 230 from rotating about its longitudinal axis when a key engages the cylindrical protrusion.

F. Alternative Key

Figure 22:
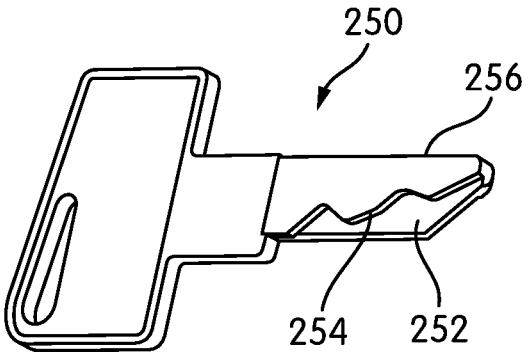
FIG. 22 is a perspective view of a squiggle key configured to be used in a lock embodying aspects of the present disclosure.

FIG. 22 is a perspective view of a squiggle key 250 to be used in a lock embodying aspects of the present disclosure. Key 250 includes a blade 256 with a bitting contour 254 extending along at least a portion of the length of the blade 256. The bitting contour 254 extends into only a portion of the thickness of the blade 256, thereby forming a relief area 252 where a portion of the thickness of the blade is removed. The biting contour 254 and relief 252 may be formed on one or both sides of the blade. In addition, although not shown, key 250 may further include a bitted edge, such as bitted edge 146 of key 140, formed along one or both edges of the blade 256

Figure 24:
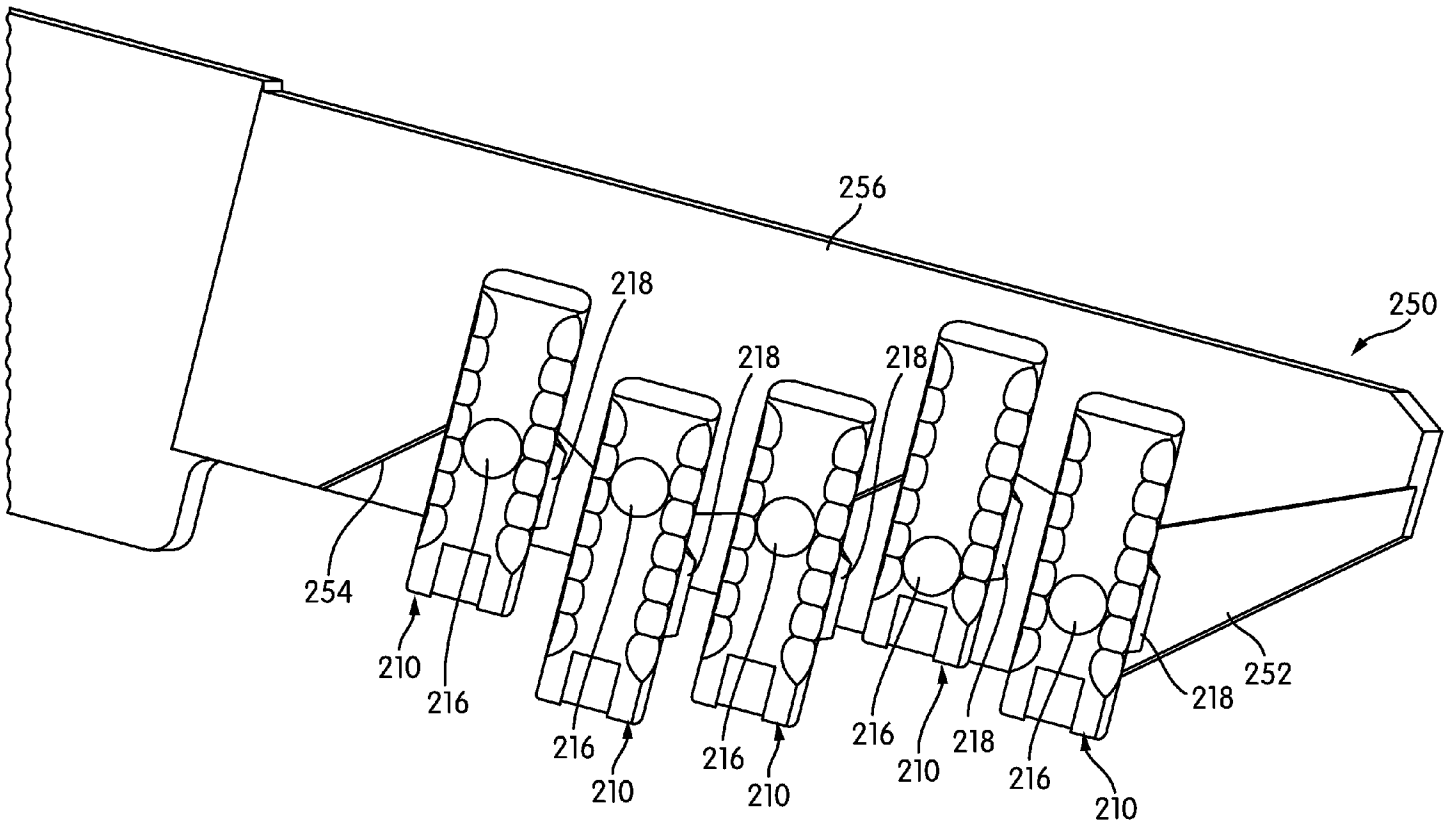
FIG. 24 is a partial perspective view of a squiggle key and code pins.

FIG. 24 is a partial perspective view of a squiggle key 250 and code pins 210. A squiggle key, such as key 250, is configured to operate with code pins 210 or code pins 230. The bitting contour 254 of the blade 250 engages the key projection 218 of each code pin 210 and aligns the code holes 216.

For embodiments in which code pins are provided in code pin holes on opposed sides of a keyway, the cylindrical protrusion or the key projection may extend only partially into the keyway to be engaged by a key having bitting contour and relief area formed on each side of the key blade.

II. Lock Operation

Figure 15:
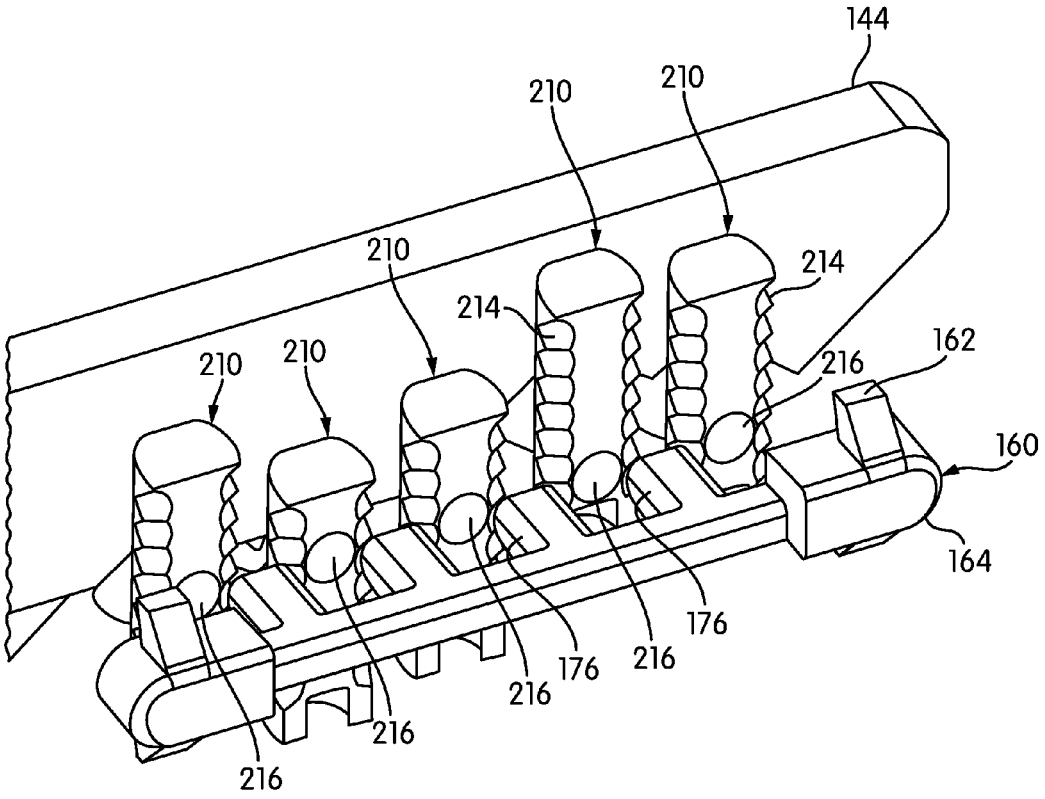
FIG. 15 is a partial perspective of the key, code pins, and the binding bar of the sidebar assembly.
Figure 16:
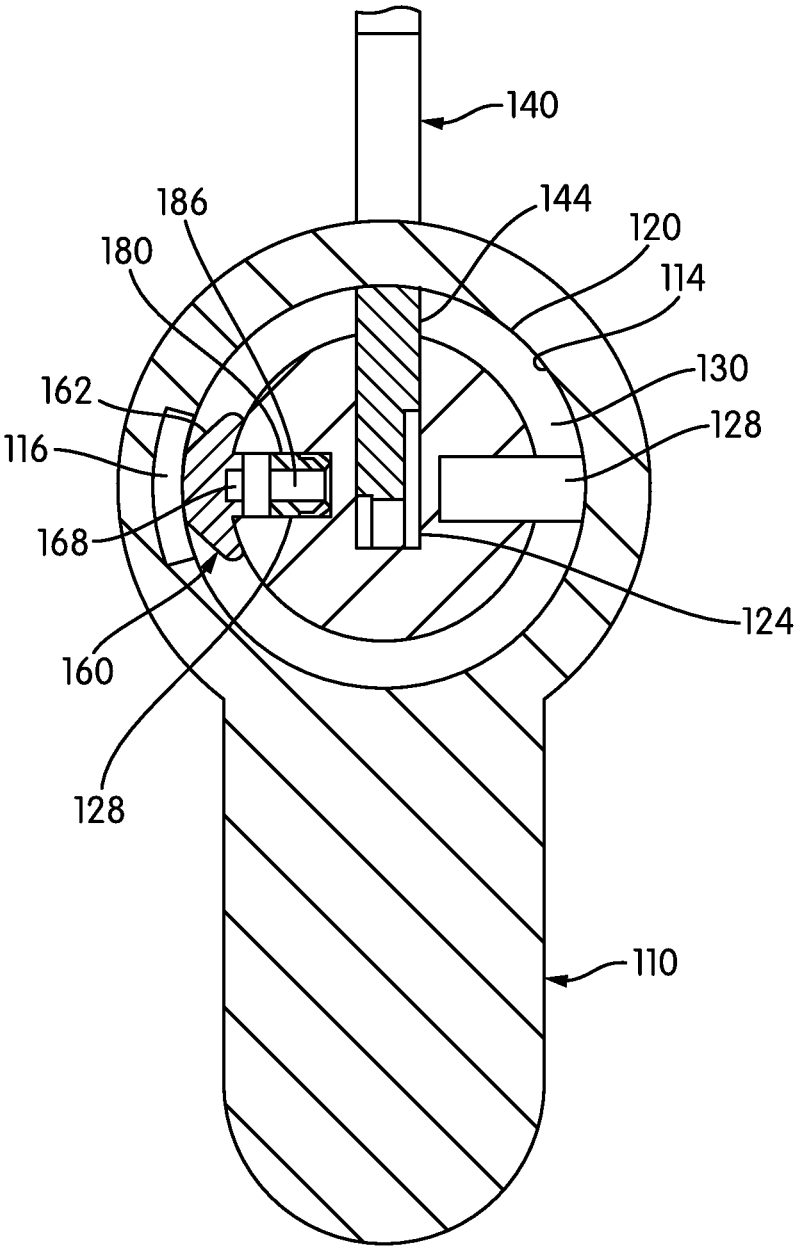
FIG. 16 is a cross-sectional view of the cylinder lock along the line F-F of FIG. 1.

Operation of the lock will be described with reference to FIGS. 3-7, 15, and 16. The sidebar assembly 150 is disposed in a sidebar slot 128 formed in the plug 120. The entire assembly 150 is biased radially outwardly by the outer springs 200 bearing against a sidewall 134 defining a side of the keyway 124 and extending through the spring holes 184 of the locking bar 180 and into the outer spring cups 166 of the binding bar 160 (see FIG. 3, springs 200 shown in FIG. 10). Thus, the springs 200 push the binding bar 160 outwardly, and the spar 170 of the binding bar 160 bears against the retainer flange 190 of the locking bar 180 (see FIGS. 3, 13) to push the entire assembly 150 into a longitudinal locking slot 116 formed in the inner surface of the bore 114 formed in the housing 110, as shown in FIG. 16.

The code pins 210 are installed into the plug with the pin bodies 212 disposed in the code pin holes 126 and the key projections 218 disposed within the keyway 124 (see FIG. 3). The code pins are biased toward the open ends of the code pin holes 126 (and the open edge of the keyway 124) by springs (not shown) each having one end retained in the spring hole 222 of each code pin 210 and an opposite end retained within the blind end of the corresponding code pin hole 126.

Figure 5:
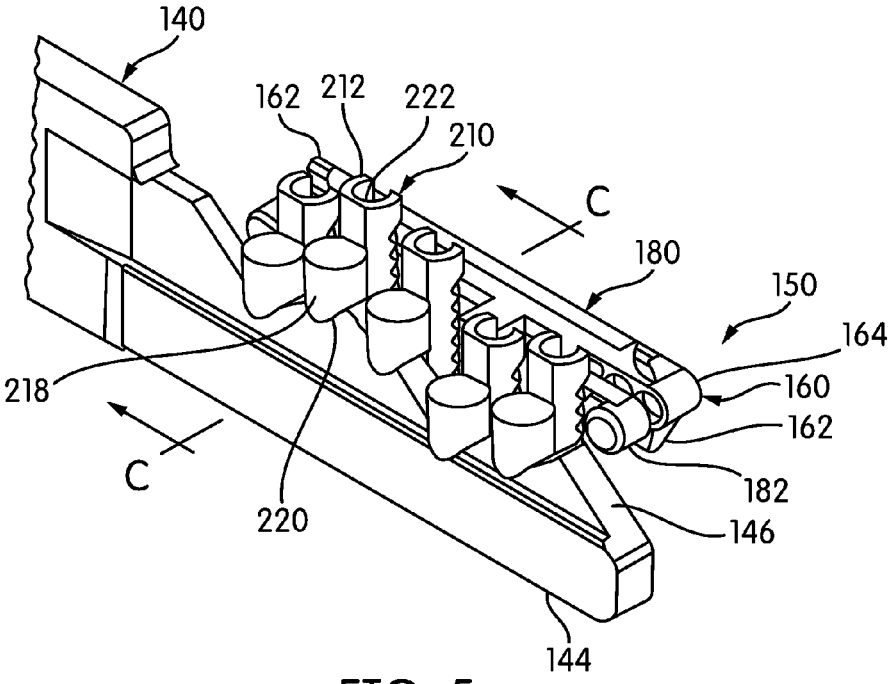
FIG. 5 is a partial perspective view showing the key, code pins, and a sidebar assembly of the lock.
Figure 6:
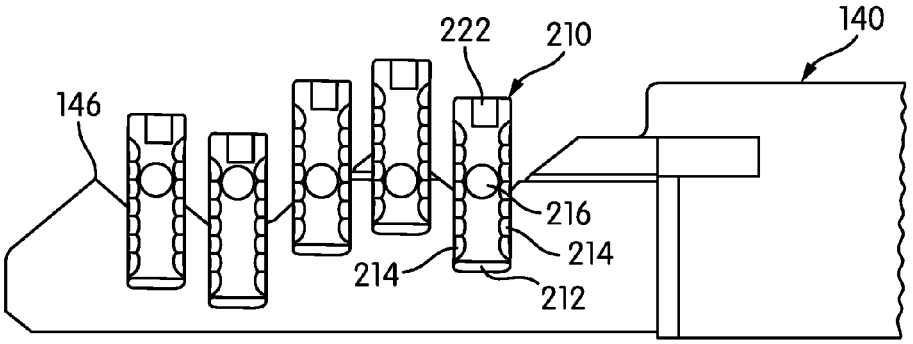
FIG. 6 is a partial side view of the key and the code pins of the lock.
Figure 7:
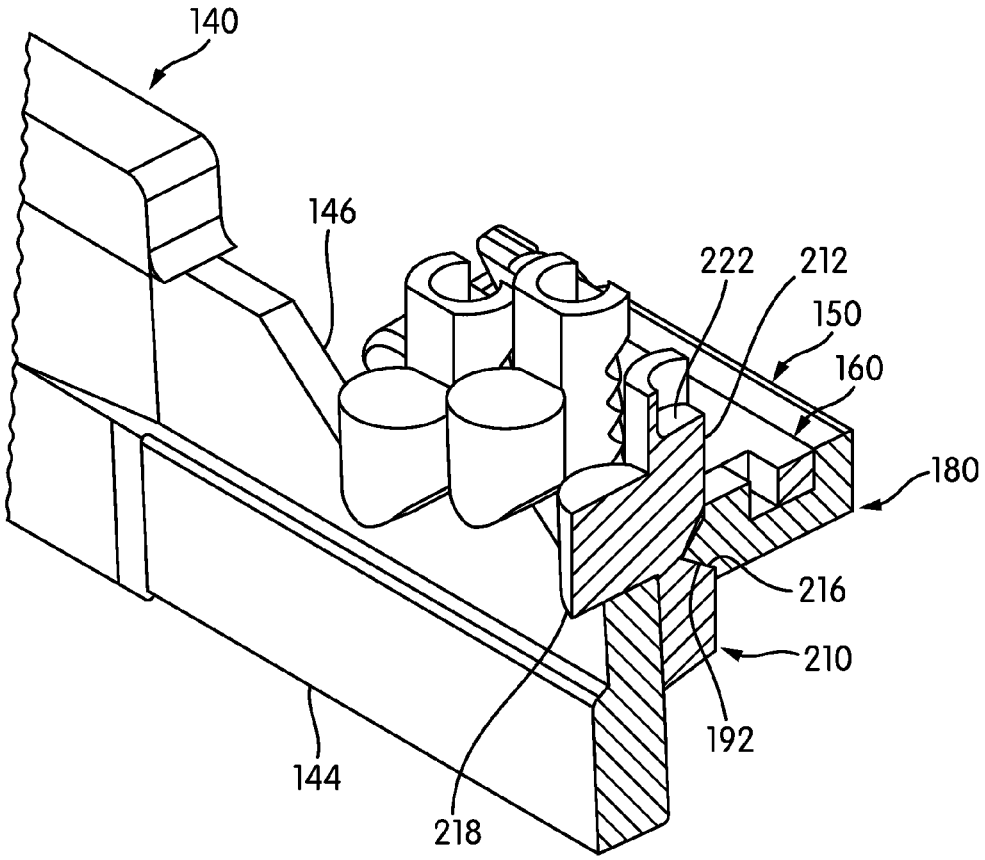
FIG. 7 is a perspective, cross-sectional view of the key, code pins, and the sidebar assembly along the line C-C in FIG. 5.
Figure 9:
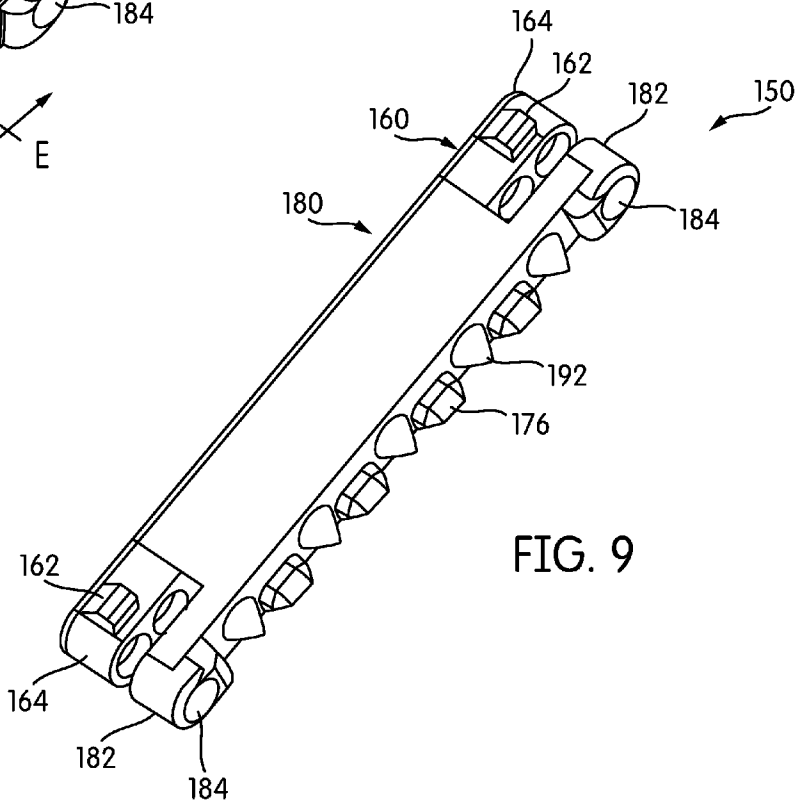
FIG. 9 is an opposed perspective view of the sidebar assembly.
Figure 8:
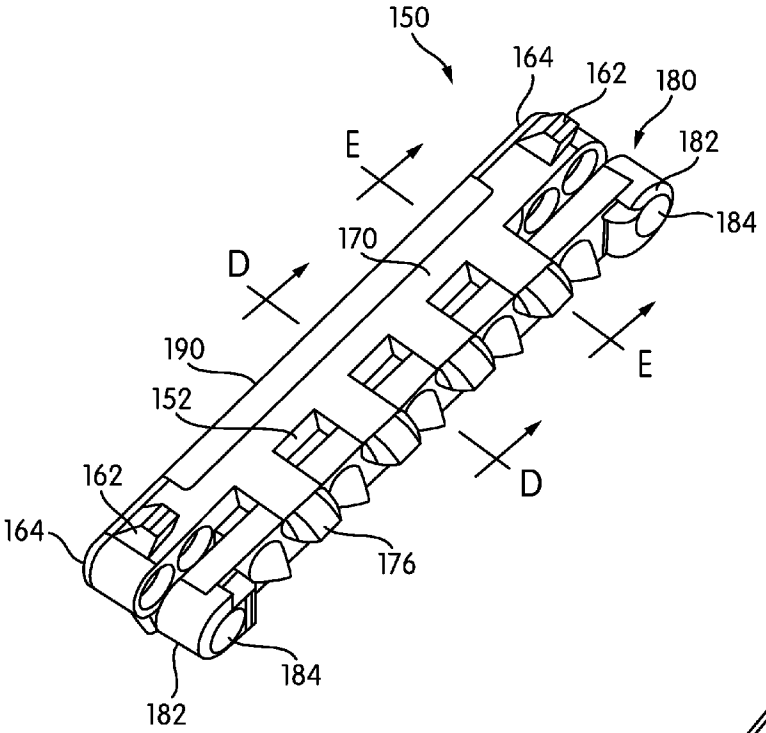
FIG. 8 is a perspective view of a sidebar assembly of the lock.

When the key 140 is inserted into the keyway 124 of the plug 120, the bitted surface 146 of the key engages and contacts the chisel points 220 of the code pins 210. Assuming a key with the correct configuration of the bitting 146 is inserted into the keyway, the code pins 210 are positioned so that the code holes 216 are aligned as shown in FIGS. 5 and 6. Movement of the bottom of the key projection 218 is accommodated by holes 136 extending into the keyway 124 (see FIG. 4). It should be noted that the FIGS. 5, 6, and 7 are upside down relative to the orientation of the lock as shown in FIG. 1.

In various embodiments, the locking, or testing, sidebar 180 has a squared outer edge at retainer flange 190, and the locking slot 116 in the shell or housing 110 is wider than the width of the projecting sidebar edge. The width of the locking slot 116 is provided to allow partial, limited rotation of the plug 120 to cause the binding sidebar 160 to move into a binding position against the code pins 210 before the projecting edge of the locking sidebar 180 contacts squared edges of the locking slot 116. Referring to FIG. 16, as a torque is applied to the plug 120 and the plug 120 partially rotates, the bridges 162 on each of the end portions 164 of the binding bar 160 engage the sides of the locking slot 116 formed in the housing 110. The beveled surfaces of the bridges 162 act as a cam surface to cause the binding bar 160 to move radially inwardly against the bias of the outer springs 200, thereby moving the binding points 176 into contact with the binding teeth 214 of the code pins, as shown in FIG. 15, which is a partial perspective view of the key blade 144, code pins 210, and the binding bar 160, without the plug 120 or the locking sidebar 180 shown in the figure. The bridges 162 retract from the slot 116 into the first and second circumferential grooves 130, 132 of the plug 120 (see FIGS. 2-4).

FIG. 16 shows the binding bar 160 withdrawn from the locking slot 116 while aligned with the center of the locking slot 116. Under normal operation, however, the plug 120 must be partially rotated clockwise or counter-clockwise so that the bridges 162 engages the edges of the locking slot 116 to move the binding art 160 out of the locking slot.

With the binding points 176 moved into contact with the binding teeth 214 of the code pins 210, the code pins 210 are bound by the binding bar 160 and thereby cannot be moved up or down with the binding bar 160 retracted from the locking slot 116. The inner springs 198 extending between the locking bar 180 and the binding bar 160 bias the locking bar 180 radially inwardly relative to the binding bar 160. Thus, if unblocked, the locking bar 180 would move radially inwardly with the binding bar 160. If the code pins 210 are properly positioned so that the code holes 216 are aligned with the code points 192 of the locking bar 180, the locking bar 180 is unblocked and able to move radially inwardly with the binding bar 160, thereby also moving the locking bar 180 out of the locking slot 116 of the housing 110. On the other hand, if the code pins 220 are not properly positioned, the code points 192 will contact a side of the pin body 212 of one or more of the code pins 210 as the binding bar 160 moves radially inwardly. Due to a gap 152 between the binding bar 160 and the locking bar 180 (see FIGS. 3 and 8), the binding bar 160 can move relative to the locking bar 180, thereby compressing the inner springs 198 between the binding bar 160 and the locking bar 180. Accordingly, if the binding bar 160 moves inwardly, but the locking bar 180 is blocked from moving inwardly, a portion of the locking bar, such as the retainer flange 190, remains within the locking slot 116, and the plug 120 is thereby blocked from rotating.

III. Second Embodiment

Figure 25:
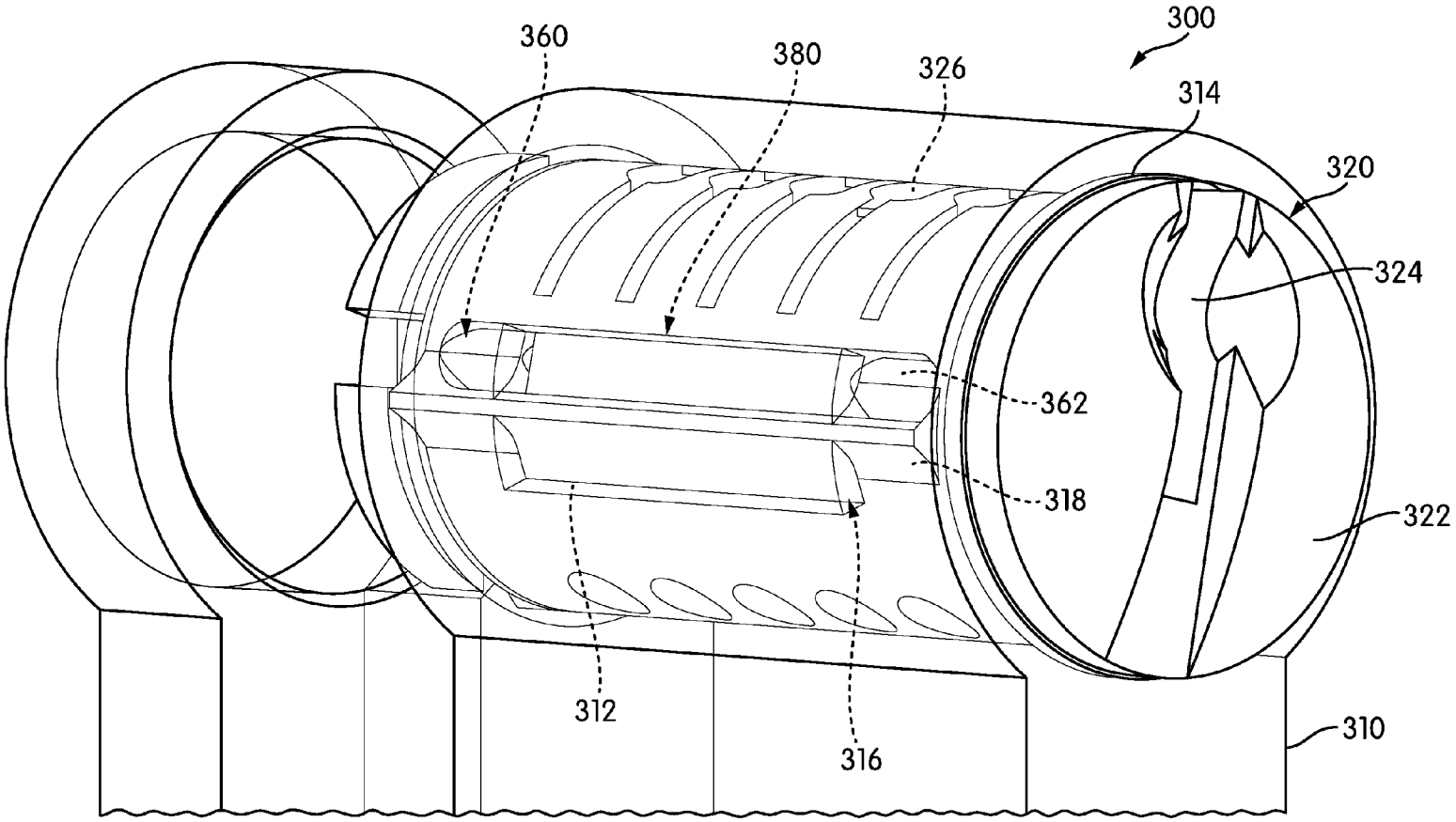
FIG. 25 is a perspective view of alternative embodiment of a lock embodying aspects of the present disclosure.

An alternative embodiment of a lock assembly 300 embodying aspects of the present disclosure is shown in FIGS. 25-29. The assembly includes a housing 310 having a bore 314 formed therein which receives a cylinder lock plug 320. FIG. 25 is a partial perspective view whereby the housing 310 is "transparent" so that features of the plug 320 can be seen through the housing 310. A key (not shown) inserted into a keyway 324 of the plug 320 operates the lock.

Plug 320 includes a head 322 at a front end thereof that projects from the housing 310 of the lock. A sidebar assembly 350 is disposed within a sidebar slot 328 formed in the plug 320 and which is oriented longitudinally along the length of the plug. Plug 320 may include, in one embodiment, two diametrically opposed sidebar slots. Plug 320 may further include a plurality of pin holes 326 aligned along the keyway 324 to receive code pins, such as any of the code pins described above.

Figure 26:
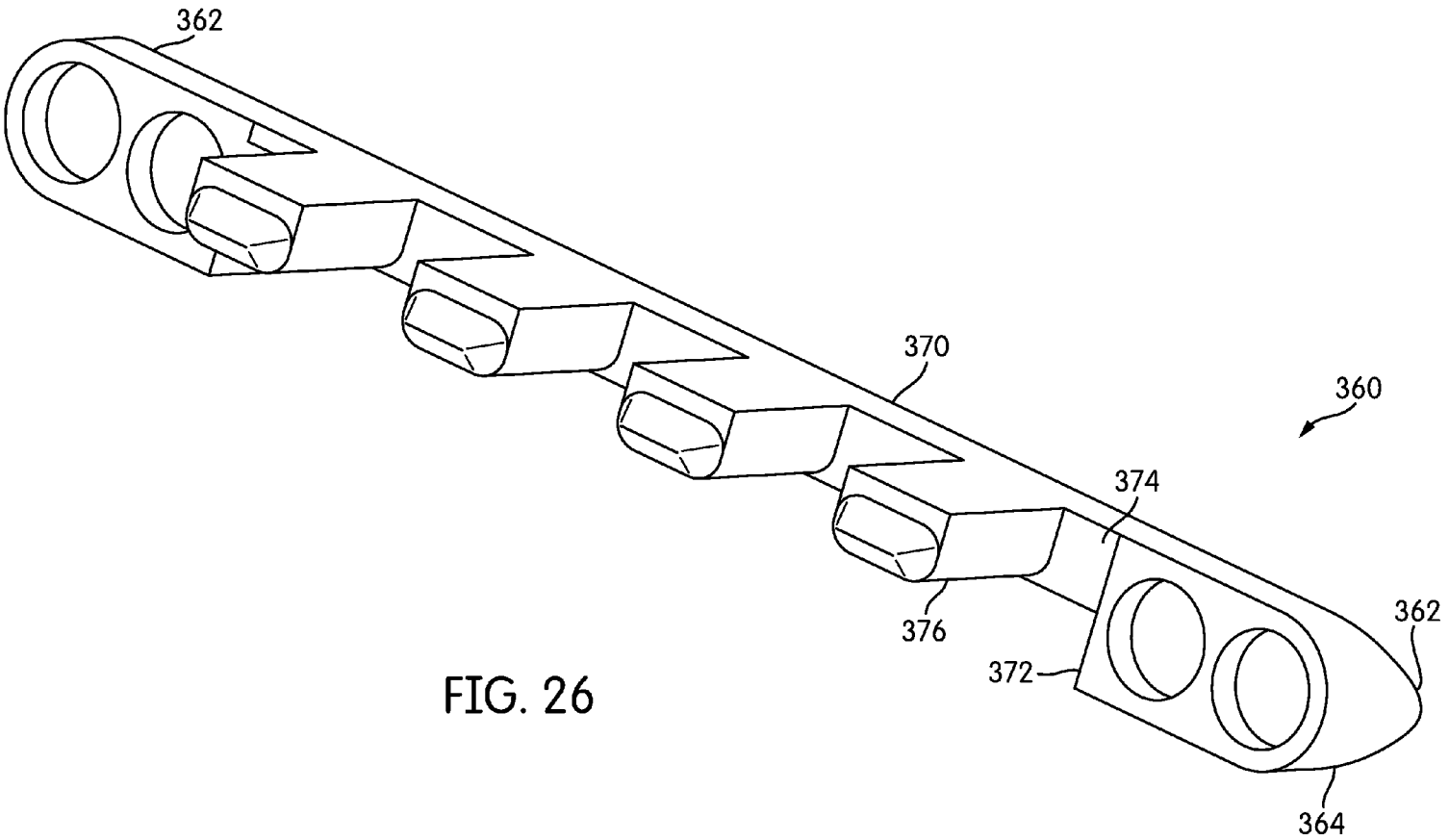
FIG. 26 is a perspective view of an alternative embodiment of a binding bar.

The sidebar assembly 350 includes a binding bar 360 and a locking, or testing, bar 380, which are operatively coupled together. As shown in FIG. 26, the binding bar 360 includes end portions 364 at opposite ends thereof and a longitudinal element, or spar, 370 extending between the end portions 364. Unlike the binding bar 160 described above, which includes cam features, such as laterally extending, sloped or beveled bridges 162, binding bar 360 includes end portions having cam features, such as pointed outer edges 362. A plurality of binding points 376 extend laterally from longitudinally-spaced apart positions from the longitudinal element 370.

In various embodiments, the locking bar 380 is substantially the same as locking bar 180 described above.

Figure 28:
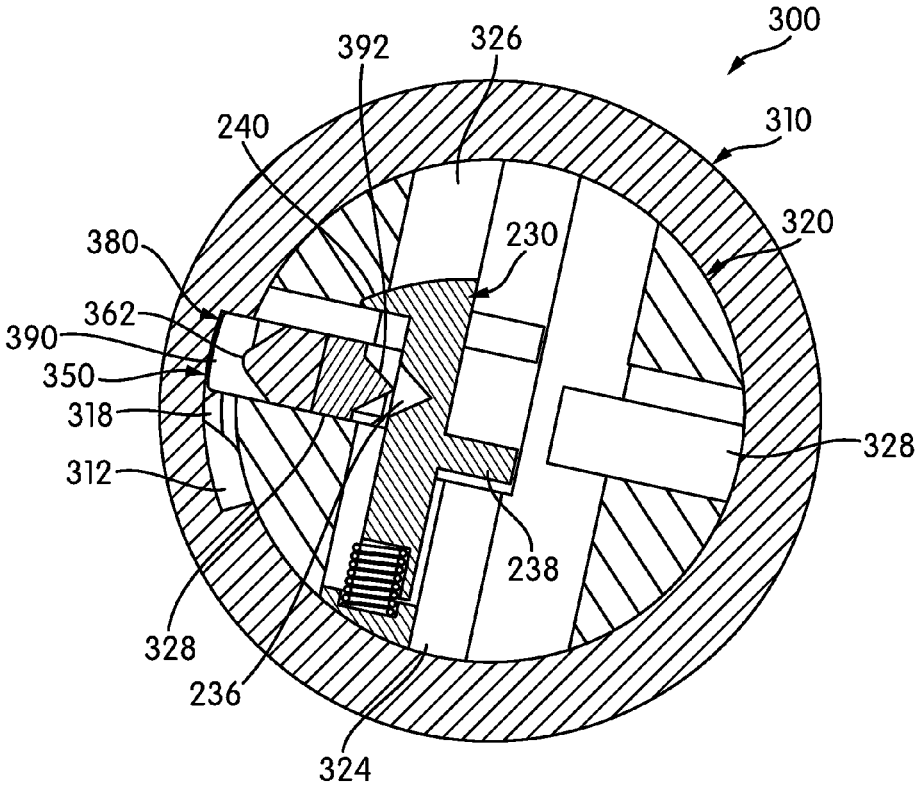
FIG. 28 is a transverse cross section of the lock of FIG. 25 in a transitional position.
Figure 29:
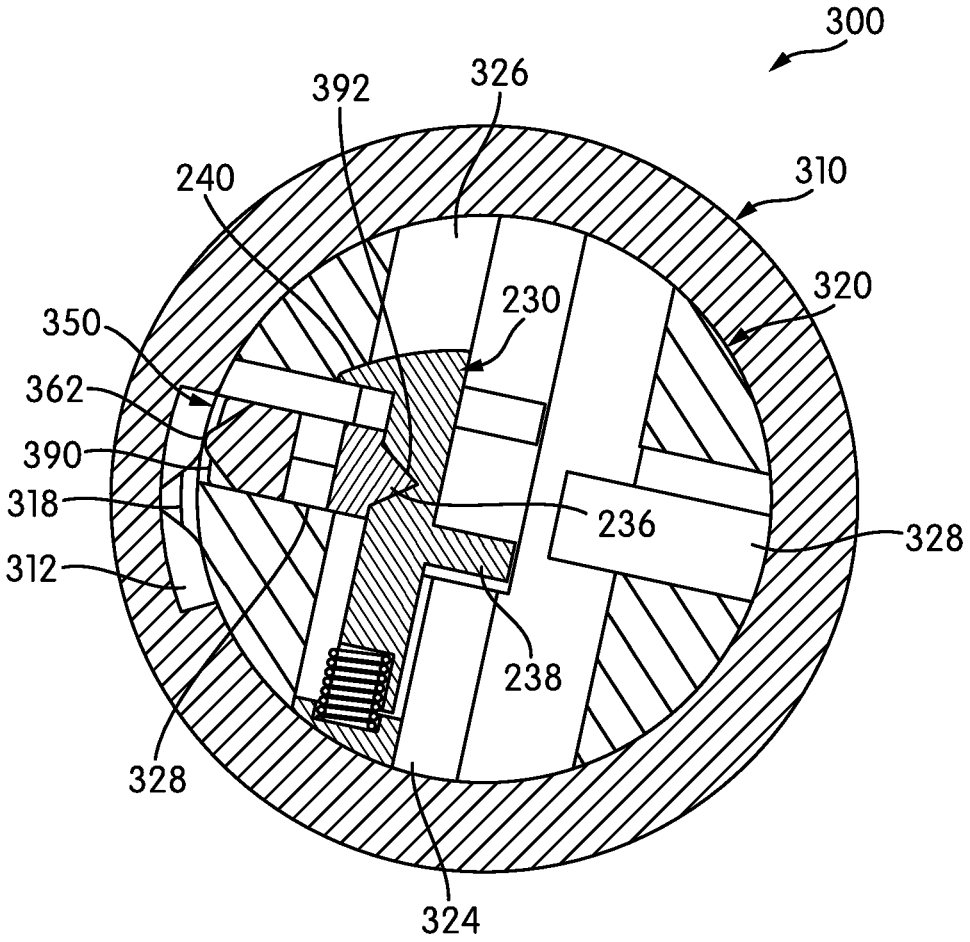
FIG. 29 is a transverse cross section of the lock of FIG. 25 in an unlocked position

Operation of the lock will be described with reference to FIGS. 27-29.

Figure 27:
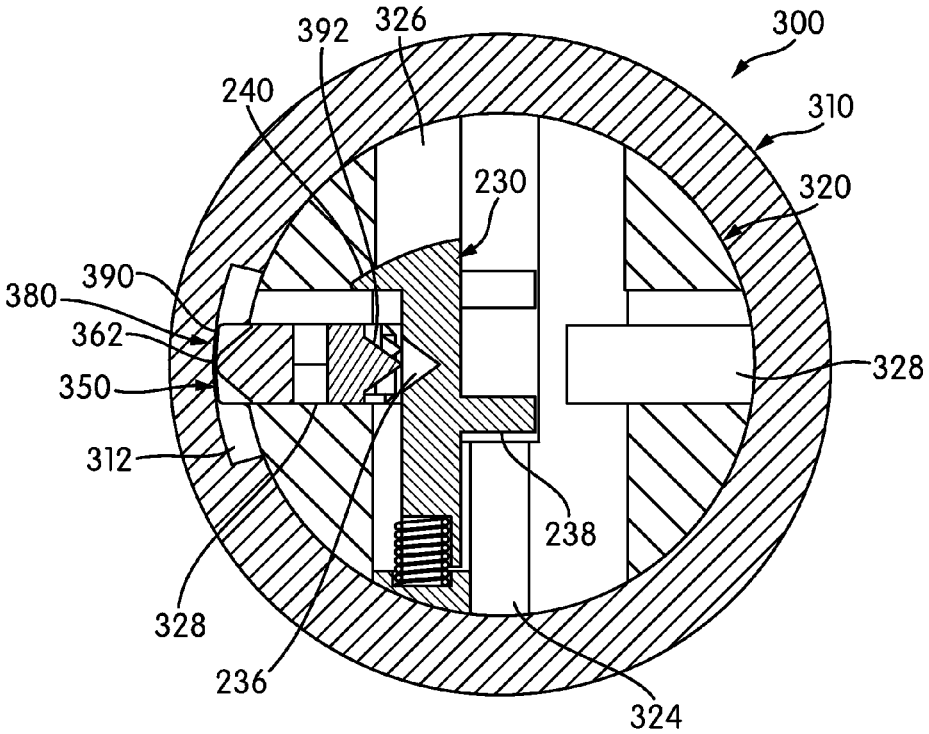
FIG. 27 is a transverse cross section of the lock of FIG. 25 in a locked position.

As shown in FIG. 27, the sidebar assembly 350 is initially disposed in a locking slot 316 formed in the plug 320 and is biased radially outwardly into the locking slot 316. The locking slot 316 is comprised of V-grooves 318 having sloped sides at the ends of the slot and a center portion 312 between the V-grooves 318 that has generally straight sides and is wider than the side bar assembly (See FIG. 25).

In various embodiments, locking, or testing, sidebar 380 has a squared exterior edge 390, and the center portion 312 of the locking slot 316 in the shell or housing 110 is wider than the width of the projecting sidebar edge 390. The width of the locking slot is determined to allow the binding sidebar 360 to move into a binding position against the code pins before the projecting edge 390 of the locking sidebar 380 contacts squared edges of the center portion 312 of the locking slot 316. Referring to FIG. 28, as a torque is applied to the plug 320 and the plug is partially rotated, pointed edges 362 at each of the end portions 364 of the binding bar 360 engage the sloped sides of the V-groove portions 318 of the slot formed in the housing 310. The sloped sides of the V-groove 318 cause the binding bar 360 to move radially inwardly, thereby moving the binding points 376 into contact with binding teeth of code pins 230 within the plug 320.

With the binding points engaged with the code pins 230, the code pins are bound by the binding bar 360 and thereby cannot be moved up or down with the binding bar 360 retracted from the locking slot 316. The locking bar 380 is biased radially inwardly relative to the binding bar 360 by a spring between the binding bar 360 and the locking bar 380. Thus, if unblocked, the locking bar 380 would move radially inwardly with the binding bar 360. If the code pins 230 are properly positioned so that the code holes 236 are aligned with the code points 392 of the locking bar 380, the locking bar 380 is unblocked and able to move radially inwardly with the binding bar 360, thereby moving the locking bar 380 out of the center portion 312 of the locking slot 316 of the housing 310 so that the plug 320 can rotate. On the other hand, if the code pins 230 are not properly positioned, the code points 392 will contact a side of the pin body of one or more of the code pins 230 as the binding bar 360 moves radially inwardly. Accordingly, if the binding bar 360 moves inwardly, but the locking bar 380 is blocked from moving inwardly, the outer edge 390 of the locking bar 380 remains within the center portion 312 of the locking slot 316, and the plug 320 is thereby blocked from rotating.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present disclosure. Moreover, the descriptions of such embodiments, combinations, and sub-combinations is not intended to convey that the subject matter disclosed herein requires features or combinations of features other than those expressly recited in the claims. Accordingly, the present disclosure is deemed to include all modifications and variations encompassed within the spirit and scope of the any appended claims.

The invention claimed is:

1. A lock assembly comprising:

a housing including a bore and a locking slot extending longitudinally along an inner surface of said bore;

a plug rotatably disposed within the bore of said housing, said plug including a sidebar slot and a keyway;

a plurality of code pins transversely mounted for radial movement within said plug, each code pin comprising binding features, a code hole, and a key engaging surface disposed within said keyway; and a sidebar assembly disposed with the sidebar slot formed in said plug and comprising a binding bar and a locking bar operatively coupled together, said binding bar comprising cam features and binding projections, and said locking bar comprising code points, wherein a portion of said sidebar assembly initially extends into the locking slot and the sidebar assembly and the locking slot are cooperatively configured to permit only partial rotation of the plug with respect to the housing, and wherein the cam features of said binding bar engage a portion of the locking slot as the plug is partially rotated with respect to the housing so that the binding bar is urged out of the locking slot and into the plug such that the binding projections of the binding bar engage the binding features of the code pins to prevent radial movement of the code pins, wherein the locking bar is configured for movement with the binding bar out of the locking slot to permit rotation of the plug if the code pins are positioned by a key engaging the key-engaging surfaces to align the code holes of the code pins with the code points of the locking bar, so that the code points may enter the code holes, and wherein the locking bar is configured for movement with respect to the binding bar if the code pins are not positioned with the code holes aligned with the code points and movement of the locking bar with the binding bar is blocked by the code points contacting the code pins, thereby preventing the locking bar from moving out of the locking slot, thus preventing further rotation of the plug.

2. The lock assembly of claim 1, wherein the sidebar assembly is biased outwardly with respect to the plug and the locking bar is biased radially inwardly with respect to the binding bar.

3. The lock assembly of claim 1, wherein said locking bar comprises end portions, a web section extending between said end portions, a retainer flange extending laterally from one edge of said web section, a plurality of spaced-apart projecting legs extending from an opposite edge of said web section, and a code point projecting from each projecting leg; and said binding bar comprises end portions, a spar extending between said end portions, said spar being disposed between said retainer flange and said projecting legs of said locking bar, and a plurality of spaced apart binding projections extending from said spar, wherein each binding projection extends through a gap adjacent one of said projecting legs of said locking bar.

4. The lock assembly of claim 3, wherein each end portion of said locking bar is disposed adjacent a corresponding end portion of said binding bar, and wherein said sidebar assembly further comprises a spring disposed between each end portion of said locking bar and the corresponding end portion of said binding bar.

5. The lock assembly of claim 3, wherein said cam features comprise beveled bridges extending laterally from the end portions of said binding bar, said beveled bridges being configured to engage an edge of the locking slot as the plug is rotated to urge the binding bar radially inwardly.

6. The lock assembly of claim 3, wherein said cam features comprise a pointed outer edge at each end portion of said binding bar, each pointed outer edge engaging a v-shaped portion of said locking slot and being configured to urge the binding bar radially inwardly as the plug is rotated.

7. The lock assembly of claim 1, wherein said locking slot has a generally constant shape throughout its length and has squared edges.

8. The lock assembly of claim 1, wherein said locking slot has, disposed along its length, at least one v-shaped portion and at least one portion with squared edges.

9. The lock assembly of claim 1, wherein each code pin comprises:

a pin body, wherein said binding features comprise binding teeth formed along at least one side of said pin body and said code hole is formed in said pin body, said pin body being disposed within a code pin hole formed in said plug adjacent said keyway and extending transversely with respect to the longitudinal axis of said plug; and a key projection extending from said pin body and disposed within said keyway.

10. The lock assembly of claim 9, wherein said key projection of said code pin includes a chisel point configured to be engaged by a bitting edge of a key inserted into said keyway.

11. The lock assembly of claim 9, wherein said key projection of said code pin comprises a cylindrical protrusion.

12. The lock assembly of claim 9, further comprising a spring hole extending into one end of said pin body.

13. The lock assembly of claim 9, wherein said pin body has a shape of a cylinder with opposed flattened sides.

14. The lock assembly of claim 1, wherein said code pins are disposed along one or both sides of said keyway.

15. The lock assembly of claim 1 comprising two sidebar assemblies, each disposed in an associated sidebar slot.

16. The lock assembly of claim 1, wherein said plug is operatively coupled to a latch mechanism such that rotation of said plug effects operative actuation of the latch mechanism.

17. The lock assembly of claim 1, further comprising a key having a key blade having at least one of a bitting edge and a bitting contour configured to contact the key engaging surfaces of the code pins when the key is inserted into the keyway and to elevate each code pin to a predetermined position.

* * * * *